US007637981B2

(12) United States Patent
Kuribayashi et al.

(10) Patent No.: US 7,637,981 B2
(45) Date of Patent: Dec. 29, 2009

(54) COMPOSITE WEAR-RESISTANT MEMBER AND METHOD FOR MANUFACTURE THEREOF

(75) Inventors: Nobuhiro Kuribayashi, Kashiwazaki (JP); Kozo Ishizaki, Nagaoka (JP); Koji Matsumaru, Nagaoka (JP)

(73) Assignees: TIX Corporation, Tokyo (JP); Nagaoka University of Technology, Niigata (JP)

( * ) Notice: Subject to any disclaimer, the term of this patent is extended or adjusted under 35 U.S.C. 154(b) by 225 days.

(21) Appl. No.: 11/660,705

(22) PCT Filed: Jan. 24, 2006

(86) PCT No.: PCT/JP2006/001033

§ 371 (c)(1),
(2), (4) Date: Feb. 21, 2007

(87) PCT Pub. No.: WO2006/080302

PCT Pub. Date: Aug. 3, 2006

(65) Prior Publication Data

US 2008/0107896 A1 May 8, 2008

(30) Foreign Application Priority Data

Jan. 25, 2005 (JP) ..... 2005-016581

(51) Int. Cl.
*C22C 26/00* (2006.01)
*C22C 29/00* (2006.01)

(52) U.S. Cl. ..... 75/240; 75/243; 419/11; 419/18; 419/48

(58) Field of Classification Search ..... 75/240, 75/243; 419/11, 18, 48
See application file for complete search history.

(56) References Cited

U.S. PATENT DOCUMENTS

| | | | | |
|---|---|---|---|---|
| 3,036,907 | A * | 5/1962 | Bibbins | 75/231 |
| 3,515,524 | A * | 6/1970 | Grambal | 75/237 |
| 4,378,975 | A | 4/1983 | Tomlinson et al. | |
| 4,525,178 | A | 6/1985 | Hall | |
| 5,096,465 | A | 3/1992 | Chen et al. | |
| 5,288,676 | A * | 2/1994 | Shimada et al. | 501/93 |
| 5,723,177 | A | 3/1998 | Brandrup-Wognsen et al. | |
| 6,170,583 | B1 | 1/2001 | Boyce | |
| 6,180,235 | B1 * | 1/2001 | Leutner et al. | 428/402 |
| 6,372,012 | B1 | 4/2002 | Majagi et al. | |

FOREIGN PATENT DOCUMENTS

| | | | |
|---|---|---|---|
| JP | 05-001304 | A | 1/1993 |
| JP | 05-239585 | A | 9/1993 |
| JP | 06-287076 | A | 10/1994 |
| JP | 08-109431 | A | 4/1996 |
| JP | 09-087775 | A | 3/1997 |
| JP | 09-194978 | A | 7/1997 |
| JP | 2001-192760 | A | 7/2001 |

OTHER PUBLICATIONS

International Search Report.

* cited by examiner

*Primary Examiner*—Roy King
*Assistant Examiner*—Ngoclan T Mai
(74) *Attorney, Agent, or Firm*—Rader, Fishman & Grauer, PLLC

(57) ABSTRACT

Provided are a composite wear-resistant member which can be manufactured with a lowered sintering temperature, and thus can prevent the carbonization of a material around super hard particles such as diamond; and a method for manufacturing the member. The member, characterized in that it comprises hard particles comprising diamond particles and WC particles and an iron group metal containing phosphorus as a binding material, wherein the content of phosphorus is 0.01 to 2.0 wt % relative to the total weight of the WC particles and the binding material.

20 Claims, 3 Drawing Sheets

50 μm

50 μm

50 μm

COMPOSITE WEAR-RESISTANT MEMBER AND METHOD FOR MANUFACTURE THEREOF

TECHNICAL FIELD OF THE INVENTION

The present invention relates to a dense and hard composite wear-resistant member containing superhard particles (diamond particles or cBN particles (cubic boron nitride)) and a method for manufacturing the same.

DESCRIPTION OF THE RELATED ART

A sintered body including diamond particles is generally manufactured at a high temperature and under a super-high pressure. However, in recent years, there has been researched a method in which the sintered body with diamonds, WC and an iron-based metal is quickly manufactured under a pressure that is not super-high by use of an spark plasma sintering process (see Patent Documents 1 and 2). However, when the pressure is not super-high, the diamond is brought into an unstable state, and the diamond will transfer to graphite at high temperature during sintering. When the article is graphitized around the diamond particles, a graphitized portion of the article will wear in the early stages, and the diamond particles drop off.

A research is performed in which the diamond is variously coated in order to prevent such transformation (see Patent Documents 3 to 5).

Patent Document 1: JP-A-5-1304;

Patent Document 2: JP-A-6-287076;

Patent Document 3: JP-A-5-239585;

Patent Document 4: JP-A-9-194978; and

Patent Document 5: JP-A-2001-192760.

BRIEF SUMMARY OF THE INVENTION

A main object of the present invention is to provide a composite wear-resistant member and a method for manufacturing the same in which a sintering temperature can be lowered in order to prevent graphitization of the surfaces of superhard particles such as diamonds.

To achieve the object, according to the present invention, there is provided a composite wear-resistant member comprising: superhard particles including diamond particles and hard particles including WC particles; and a binding material including a phosphorus-containing iron group metal, wherein a content of phosphorus is 0.01 to 2.0 wt % with respect to a total weight of the WC particles and the binding material.

The diamond particles as the superhard particles are individually independently dispersed in WC and the binding material, a content of the diamond particles is 1 to 60 vol %, preferably 5 to 40 vol %, and a content of the binding material is 3 to 30 wt %, preferably 6 to 25 wt %.

The diamond particles as the superhard particles have a diameter of 1000 μm or less, preferably 5 to 100 μm, and the WC particles have a diameter of 10 μm or less, preferably 0.5 to 5 μm. Instead of the diamond particles, cBN particles may be used.

Moreover, in order to achieve the above object, there is provided a method for manufacturing a composite wear-resistant member, comprising: a step of adjusting a ratio of phosphorus with respect to a material comprising superhard and hard particles including diamond particles and tungsten carbide (WC) particles and a phosphorus (P)-containing binding material to set an proper sintering temperature to 900-1100° C.; and a step of performing hot-press sintering or spark plasma sintering.

In the step of setting the proper sintering temperature to 900-1100° C., a content of phosphorus is adjusted into 0.01 wt % to 2.0 wt % with respect to a total weight of the WC particles and the binding material.

A content of the diamond particles is 1 to 60 vol %, preferably 5 to 40 vol %. A content of the binding material is 3 to 30 wt %, preferably 6 to 25 wt %.

The diamond particles as the superhard particles have a diameter of 1000 μm or less, preferably 5 to 100 μm, and the WC particles have a diameter of 10 μm or less, preferably 0.5 to 5 μm.

Instead of the diamond particles, cBN particles may be used.

ADVANTAGES OF THE INVENTION

According to the present invention, a ratio of phosphorus is adjusted so that an proper sintering temperature of a material comprising superhard and hard particles including diamond particles and a phosphorus-containing binding material is 900° C. to 1100° C. Therefore, it is possible to perform hot-press sintering or spark plasma sintering at low temperature. Since the proper sintering temperature is low, a quality of the surfaces of the diamond particles hardly change, so that a graphitized layer is hardly generated, and the diamond particles can be dispersed inexpensively in WC particles and a phosphorus-containing iron group metal without changing the quality of the diamond.

DETAILED DESCRIPTION OF THE INVENTION

Figure 1:
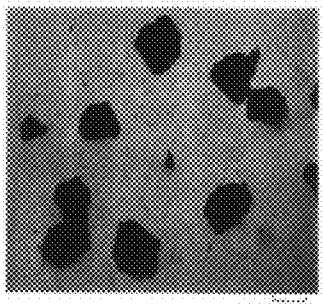
FIG. 1 is a photograph of an optical microscope showing a structure of a sample of Embodiment 1.

The largest characteristic of a composite wear-resistant member according to the present invention lies in that a ratio of phosphorus is adjusted so that an proper sintering temperature of a material constituted of superhard and hard particles including diamond particles and a phosphorus (P) containing binding material is 900° C. to 1100° C. This composite wear-resistant member is manufactured by hot-press sintering or spark plasma sintering. The Hot-press sintering means that a graphite coil or a graphite die is inductively heated while the mold is pressurized. The spark plasma sintering means that a pulse power is supplied to the graphite die to thereby heat the die while the mold is pressurized. A reason why a lower limit of the sintering temperature is set to 900° C. is that a liquid phase is generated in a phosphorus-containing iron group metal around at 880° C., and the sintering is rapidly accelerated above this temperature. A reason why an upper limit is set to 1100° C. is that a diamond transfers to graphite in an accelerated manner in a temperature range above this upper limit.

The superhard and hard particles comprise the diamond particles and WC particles, the binding material comprises the phosphorus-containing iron group metal, and a content of phosphorus is 0.01 wt % to 2.0 wt % with respect to a total weight of WC and the iron group metal. From a viewpoint of prevention of quality change and graphitization of the diamond, a sintering temperature of 1000° C. was regarded as a standard to determine an amount of phosphorus to be added. Considering from the strength of the composite wear-resistant member, it is preferable to set an upper limit of the content of phosphorus to 1.0%.

The diamond particles as the superhard particles are individually independently dispersed in WC and the phosphorus-containing iron group metal, and a content of the diamond particles is 1 to 60 vol %. A reason why an upper limit of an amount of the diamond to be added is set to 60 vol % is that the composite wear-resistant member cannot obtain a sufficient toughness against any impact above this value. A reason why a lower limit is set to 1% is that substantial effect cannot be expected in a wear-resistant performance below this lower limit. The amount of the diamond to be added is preferably 5 to 40 vol %.

A content of the phosphorus-containing iron group metal as the binding material is 3 to 30 wt %. If the content is 3% or less, sufficient toughness of the material cannot be obtained, and the diamond particles cannot sufficiently be protected from the impact. On the other hand, if the content is 30% or more, a sufficient matrix hardness (wear resistance) cannot be obtained. The content is preferably 6 to 25 wt %.

The diamond particles as the superhard particles have a diameter of 1000 μm or less. However, if the particles are fine particles having a diameter of 5 μM or less, a surface area increases, the infiltration of the liquid phase will deteriorate during the sintering, and problems apt to occur in a sintering property. On the other hand, if the grain size is 100 μm or more, destruction can occur in the diamond particles owing to the impact. The grain size is preferably 5 to 100 μm.

Moreover, instead of the diamond particles, cBN particles can be used.

The WC particles have a diameter of 10 μm or less. However, if the diameter is 5 μm or more, the hardness of the whole wear-resistant member largely drops, and a compressive strength also drops. On the other hand, if the particles have a diameter of 0.5 μm or less, sintering conditions will be strict, and such particles are not general. The diameter is preferably 0.5 to 5 μm.

Furthermore, instead of the WC particles, metal carbide such as TiC, TaC and VC may be used alone or combined.

EMBODIMENT 1

First, 82 wt % of WC having a grain size of 2 μm, 15 wt % of Co having a grain size of 2 to 3 μm and 3 wt % of NiP (P content 10.7%, 400 meshes or less) were weighed and mixed by a ball milling method in alcohol for 48 hours. This mixed powder was sampled as much as 300 grams, and 10 grams of diamond particles having a grain size of 50 to 70 μm were added, mixed in an alcohol solution and then dried.

This mixture was sampled as much as 20 grams, and poured into a mold having a diameter of 20 mm. Hot pressing in a vacuum was performed on conditions that the mold was held under a pressure of 40 MPa at 1000° C. for 30 minutes. A composite wear-resistant member in which diamond particles were dispersed a little over 10 vol % in a fine structure of WC and a phosphorus-containing iron group metal can be prepared. An observation example by an optical microscope is shown in FIG. 1.

EMBODIMENT 2

Figure 2:
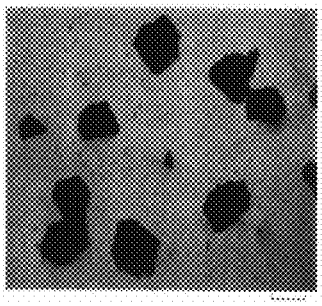
FIG. 2 is a photograph of an optical microscope showing a structure of a sample of Embodiment 2.

By a method similar to that of Embodiment 1, a composite wear-resistant member in which an amount of diamond particles to be added was set to 20 g, the diamond particles having a grain size of 50 to 70 μm, and the diamond particles were dispersed a little over 20 vol % in a fine structure of WC and a phosphorus-containing iron group metal can be prepared. An observation example by an optical microscope is shown in FIG. 2.

EMBODIMENT 3

Figure 3:
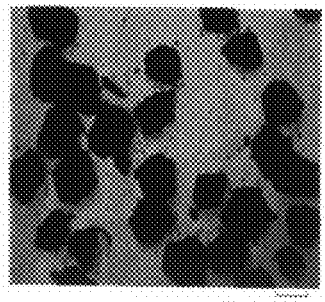
FIG. 3 is a photograph of an optical microscope showing a structure of a sample of Embodiment 3.

By a method similar to that of Embodiment 1, a composite wear-resistant member in which an amount of diamond particles to be added was set to 50 g, the diamond particles having a grain size of 50 to 70 μm, and the diamond particles were dispersed a little over 40 vol % in a fine structure of WC and a phosphorus-containing iron group metal can be prepared. An observation example by an optical microscope is shown in FIG. 3.

EMBODIMENT 4

Figure 4:
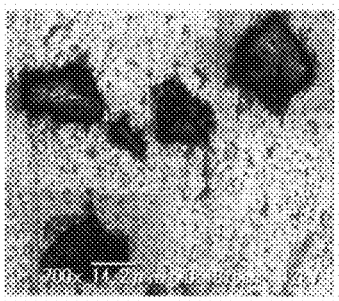
FIG. 4 is a photograph of a scanning type electron microscope showing a structure of a sample of Embodiment 4.

By a method similar to that of Embodiment 1 using fine diamond particles having a grain size of 10 to 20 μm, a composite wear-resistant member in which fine diamond particles were dispersed a little over 10 vol % in a fine structure of WC and a phosphorus-containing iron group metal can be prepared. An observation example by a scanning electron microscope is shown in FIG. 4.

EMBODIMENT 5

Figure 5:
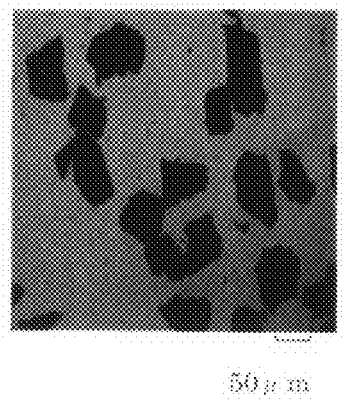
FIG. 5 is a photograph of an optical microscope showing a structure of a sample of Embodiment 5.

By a method similar to that of Embodiment 1 using boron nitride (cBN) particles having a grain size of 50 to 70 μm instead of diamond particles, a composite wear-resistant member was prepared. The composite wear-resistant member in which cBN particles were dispersed a little over 30 vol % in a fine structure of WC and a phosphorus-containing iron group metal can be prepared. An observation example by an optical microscope is shown in FIG. 5.

(Microstructure of Each Test Piece)

Any graphitization of diamond was not observed by an optical microscope. An only slight amount of cavities or voids existed, and a micro amount of Ni pool scattered.

(Graphitization of Diamond Particles)

Figure 7:
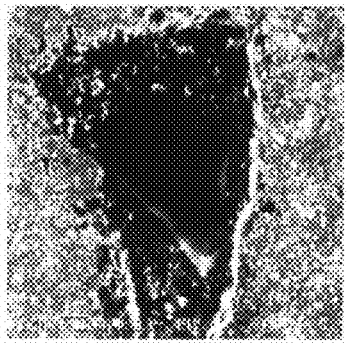
FIG. 7 is a photograph of a scanning electron microscope showing a structure of a composite wear-resistant member sintered at 1230° C.
Figure 8:
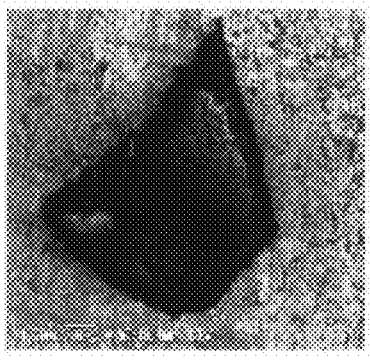
FIG. 8 is a photograph of a scanning electron microscope showing a structure of a composite wear-resistant member sintered at 1000° C.

Graphitization situations of the diamond particles were observed with a scanning electron microscope. Results of which are shown in FIGS. 7, 8. A diamond (FIG. 8) of the composite wear-resistant member sintered at 1000° C. based on the present invention shows its smooth appearance. On the other hand, the diamond particle (FIG. 7) sintered at 1230° C. lacks its outer peripheral portions and shows its remarkably coarse appearance.

Figure 9:
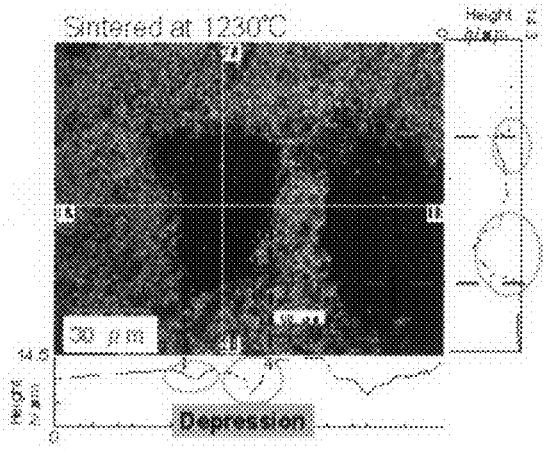
FIG. 9 shows an analysis of laser microscope of a depth of depression around diamond particles protruding and remaining on a polished surface of a composite wear-resistant member sintered at 1230° C.
Figure 10:
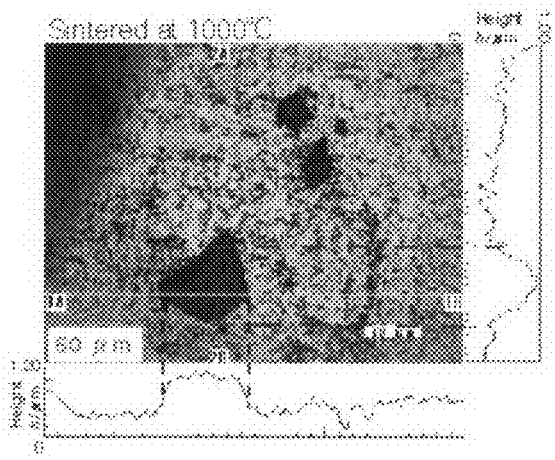
FIG. 10 shows an analysis of laser microscope of a depth of depression around diamond particles protruding and remaining on a polished surface of a composite wear-resistant member sintered at 1000° C.

To evaluate the exfoliation or drop-off of the diamond due to graphitization, a depth of depression around the remaining diamond particles protruding from a polished surface was measured with a laser microscope. As shown in FIG. 10, any depression was not generated around the diamond of the composite wear-resistant member sintered at 1000° C. On the other hand, the depression was generated around the diamond particles sintered at 1230° C. as shown in FIG. 9. It is considered that the surface of the diamond is stripped owing to deterioration of the diamond.

(Worn Amount of Grindstone by Grinding of Each Test Piece)

The wears of a diamond-grindstone during grinding the test pieces of the above embodiments were measured to estimate the quality of the diamond. Comparisons were made among the wear of a diamond-grindstone required for grinding each test piece as much as the equal amount. As compared with a test piece of a typical cemented carbide, the test pieces to which the diamond particles had been added wore the grindstone excessively much more, and an effect of the diamond was remarkable.

A test piece including 10 vol % of the diamond wore the grindstone 90 times that of a cemented carbide test piece, and a test piece including 20 vol % of the diamond wore 120 times that of the cemented carbide test piece. In addition, when each test piece was ground and polished to perform structure observation, as a result, a state in which diamond abrasive grains fell off was hardly found, and the diamond abrasive grains were not easily ground and protruded from polished surface. This indicates that the test pieces according to the above embodiments have a remarkably excellent wear-resistant characteristic and that the diamond is firmly held by a phosphorus-containing alloy matrix. Therefore, it can be estimated that the present members have enough diamond particle holding force as the composite wear-resistant material.

(Hardness, Toughness and the Like of Sample Consisting of WC and phosphorus-Containing Iron Group Metal)

To evaluate the hardness and the toughness of WC and the phosphorus-containing iron group metal matrix around the diamond particles, a test piece was prepared with a mixture of WC and the phosphorus-containing iron group metal without any diamond particle.

Three types of mixed powder in which the content of phosphorus was changed were prepared by the ball-mill mixing process as in the above embodiments, 20 grams of each powder were poured into a mold having a diameter of 20 mm, and spark plasma sintering was performed in vacuum on conditions that the mold was held under a pressure of 40 MPa at a temperature of 1000° C. for ten minutes. Comparison test results with respect to commercially available cemented carbide having an equal hardness level are shown in Table 1. It is to be noted that the commercially available cemented carbide was manufactured at a sintering temperature of 1390° C.

TABLE 1

Fracture toughness value (Comparison with commercially available cemented carbide)

| Check items | Sample 1 | Sample 2 | Sample 3 | Sample 4 | Sample 5 | Sample 6 | Commercially available cemented carbide |
|---|---|---|---|---|---|---|---|
| Content of phosphorus | 0.02% | 0.05% | 0.10% | 0.20% | 0.50% | 1.00% | 0% |
| Hardness (HRA) | — | 87.9 | 88.9 | 89.1 | 88.8 | 87.9 | 88.5 |
| Fracture toughness Klc(Mpa · $m^{1/2}$) | — | 9.7 | 10.1 | 11.5 | 11.7 | 7.1 | 12.3 |
| Sintered structure | Defective | Satisfactory | Satisfactory | Satisfactory | Satisfactory | Pool | Satisfactory |

Sample 1 was sintered at 1000° C. but was defective. Therefore, physical properties could not be measured. But a satisfactory structure was obtained at the sintering temperature of 1100° C.

Samples 2 to 5 maintain levels equal to the level of the commercially available cemented carbide.

Sample 6 has a fracture toughness value which is slightly lower than that of the commercially available cemented carbide, and a nickel pool is conspicuous, but the sample has the value that can sufficiently be used depending on the application.

(Content of Phosphorus and Shrinkage Percentage of Sintered Article)

Figure 6:
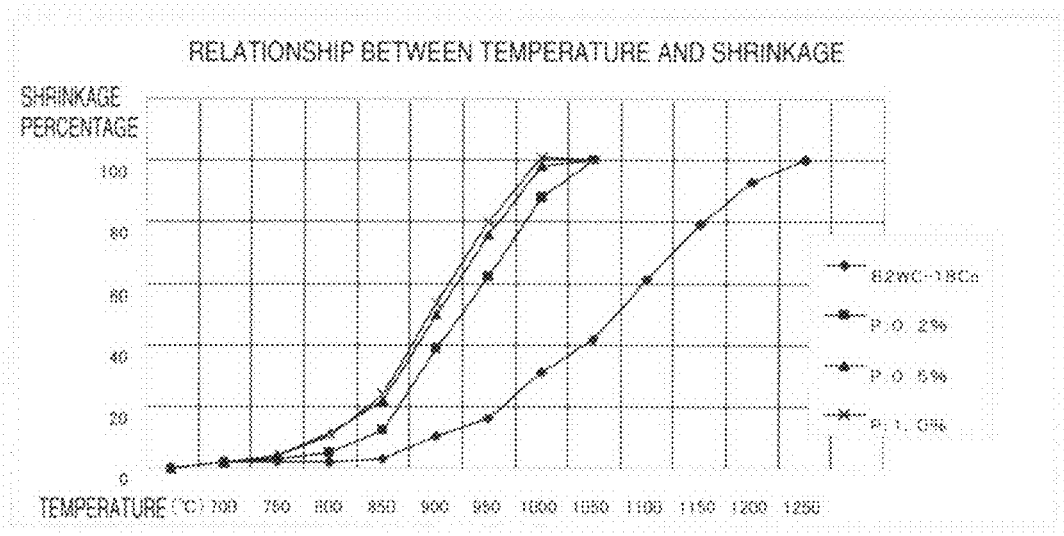
FIG. 6 is a diagram showing a relation between a temperature and a shrinkage percentage in a hot-press sintering process.

Next, progresses of the temperature and a shrinkage percentage in a spark plasma sintering process were measured with respect to an 82% WC-18% Co material including phosphorus added thereto, and results are shown in FIG. 6. Here, the shrinkage percentage indicates a shrinkage amount of the sample at each temperature in a case where it is assumed that the shrinkage amount of a completely sintered body is 100. Temperature rise conditions were that the temperature was raised 20° C. every minute to 1050° C. The shrinkage percentage was calculated from a dimensional change at times when the various temperatures were reached.

In actual sintering, a holding time at the maximum temperature is set to several minutes. Therefore, the value of the shrinkage percentage at each temperature described above largely increases depending on the setting of the holding time. For example, as shown in FIG. 6, the shrinkage percentage of the sample containing 0.2% of phosphorus at 950° C. was 62%, but increased to 98% after a holding time of ten minutes.

It is to be noted that in FIG. 6, 82% WC-18% Co indicates the commercially available cemented carbide to which any phosphorus is not added (0%).

The invention claimed is:

1. A composite wear-resistant member comprising:

superhard and hard particles including diamond particles and WC particles; and a binding material including a phosphorus-containing iron group metal, wherein a content of phosphorus is 0.05 wt % to 1.0 wt % with respect to a total weight of the WC particles and the binding material.

2. The composite wear-resistant member according to claim 1, wherein the diamond particles as the superhard particles are individually independently dispersed in the WC particles and the binding material;

a content of the diamond particles is 1 to 60 vol %; and a content of the binding material is 3 to 30 wt %.

3. The composite wear-resistant member according to claim 1, wherein the diamond particles as the superhard particles have a diameter of 1000 μm or less.

4. The composite wear-resistant member according to claim 2, wherein instead of the diamond particles, cBN particles are used.

5. The composite wear-resistant member according to claim 1, wherein said wear-resistant member is for oil drilling.

6. A method for manufacturing a composite wear-resistant member, comprising:

a step of adjusting a ratio of phosphorus with respect to a material comprising superhard and hard particles including diamond particles and WC particles and a binding material including a phosphorus (P)-containing iron group metal to set an proper sintering temperature to 900° C.-1100° C.; and a step of performing hot-press sintering or spark plasma sintering.

7. The method for manufacturing the composite wear-resistant member according to claim 6, wherein said wear-resistant member is for oil drilling.

8. A method for manufacturing a composite wear-resistant member, comprising:

a step of adjusting a ratio of phosphorus with respect to a material comprising superhard and hard particles including diamond particles and WC particles and a binding material including a phosphorus (P)-containing iron group metal to set an proper sintering temperature to 900° C.-1100° C. (except for 1100° C.); and a step of performing hot press sintering or spark plasma sintering.

9. The method for manufacturing the composite wear-resistant member according to claim 8, wherein said wear-resistant member is for oil drilling.

10. The method for manufacturing the composite wear-resistant member according to claim 8, wherein in the step of setting the proper sintering temperature to 900° C.-1100° C., a content of phosphorus is adjusted into 0.05 wt % to 1.0 wt % with respect to a total weight of the WC particles and the binding material.

11. The method for manufacturing the composite wear-resistant member according to claim 8, wherein a content of the diamond particles is 1 to 60 vol %; and a content of the binding material is 3 to 30 wt %.

12. The method for manufacturing the composite wear-resistant member according to claims 8, wherein the diamond particles as the superhard particles have a diameter of 1000 μm or less; and the WC particles have a diameter of 0.5 to 5 μm.

13. The method for manufacturing the composite wear-resistant member according to claim 8, wherein instead of the diamond particles, cBN particles are used.

14. The wear-resistant member manufactured by the method according to claim 8.

15. The composite wear-resistant member according to claim 1, wherein the content of phosphorus is 0.05 wt % to 0.5 wt % with respect to a total weight of the WC particles and the binding material.

16. The composite wear-resistant member according to claim 1, wherein fracture toughness value (Klc: $Mpa \cdot m^{1/2}$) is 9.7 or more and a hardness of a matrix is HRA 87.9 or more.

17. The composite wear-resistant member according to claim 6, wherein the content of phosphorus is 0.05 wt % to 0.5 wt % with respect to a total weight of the WC particles and the binding material.

18. The composite wear-resistant member according to claim 6, wherein fracture toughness value (Klc: $Mpa \cdot m^{1/2}$) is 9.7 or more and a hardness of a matrix is HRA 87.9 or more.

19. The composite wear-resistant member according to claim 8, wherein the content of phosphorus is 0.05 wt % to 0.5wt % with respect to a total weight of the WC particles and the binding material.

20. The composite wear-resistant member according to claim 8, wherein fracture toughness value (Klc: $Mpa \cdot m^{1/2}$) is 9.7 or more and a hardness of a matrix is HRA 87.9 or more.

* * * * *